US010500758B2

(12) United States Patent
Ciccarello et al.

(10) Patent No.: US 10,500,758 B2
(45) Date of Patent: Dec. 10, 2019

(54) CASTED BLOCK MOLDING APPARATUS AND METHOD

(71) Applicant: TECHO-BLOC INC., St-Hubert (CA)

(72) Inventors: Charles Ciccarello, St-Hubert (CA); Ian Havill, Mascouche (CA); Jean-Michel Brassard, Marieville (CA)

(73) Assignee: TECHO-BLOC INC., St-Hubert (CA)

( * ) Notice: Subject to any disclaimer, the term of this patent is extended or adjusted under 35 U.S.C. 154(b) by 334 days.

(21) Appl. No.: 15/381,226

(22) Filed: Dec. 16, 2016

(65) Prior Publication Data

US 2017/0173821 A1 Jun. 22, 2017

Related U.S. Application Data

(60) Provisional application No. 62/269,653, filed on Dec. 18, 2015.

(51) Int. Cl.

| | |
|---|---|
| ***B28B 3/02*** | (2006.01) |
| ***B28B 13/02*** | (2006.01) |
| *B28B 7/00* | (2006.01) |

(52) U.S. Cl.

CPC ..... *B28B 3/02* (2013.01); *B28B 13/022* (2013.01); *B28B 13/023* (2013.01); *B28B 7/0097* (2013.01)

(58) Field of Classification Search

CPC ... B28B 13/022; B28B 13/023; B28B 7/0097; B28B 13/0225; B28B 3/02; B30B 15/304

See application file for complete search history.

(56) References Cited

U.S. PATENT DOCUMENTS

| | | | | |
|---|---|---|---|---|
| 2,648,115 | A * | 8/1953 | Maramonte | B28B 11/14 425/130 |
| 3,217,375 | A * | 11/1965 | Kinnard | B28B 1/084 264/228 |
| 4,265,609 | A | 5/1981 | Kitahara | |
| 6,382,947 | B1 * | 5/2002 | Bryant | B01F 5/265 425/130 |
| 6,616,874 | B1 * | 9/2003 | Lazar | B28B 3/022 264/245 |
| 2002/0109265 | A1 | 8/2002 | Braungardt et al. | |

(Continued)

FOREIGN PATENT DOCUMENTS

| | | |
|---|---|---|
| EP | 0941826 | 9/1999 |
| JP | 11-034024 | 2/1999 |

*Primary Examiner* — Nahida Sultana
*Assistant Examiner* — Debjani Roy
(74) *Attorney, Agent, or Firm* — Norton Rose Fulbright Canada LLP

(57) ABSTRACT

A casted block molding apparatus, including a mold, first and second filler boxes, and a pressing mechanism. The first filler box is displaceable along opposed directions between an overlapping position where a first bottom opening is located over the mold cavities and a retracted position away from the mold cavities. The first bottom opening is closed by a first cover in the retracted position and is open over the mold cavities. The second filler box is mounted to the first filler box and displaceable therewith along the opposed directions. The bottom opening of the second filler box is closed by a second cover when the filler boxes are displaced from the retracted position to the overlapping position. The second bottom opening is open after the first filler box reaches the overlapping position. A method for molding casted blocks is also discussed.

13 Claims, 8 Drawing Sheets

(56) References Cited

U.S. PATENT DOCUMENTS

| | | | | |
|---|---|---|---|---|
| 2007/0216058 | A1 | 9/2007 | Carreras-Maldonado et al. | |
| 2010/0007051 | A1* | 1/2010 | Ness | B28B 13/0225 264/299 |
| 2014/0377393 | A1* | 12/2014 | Karau | B28B 7/00 425/127 |

* cited by examiner

CASTED BLOCK MOLDING APPARATUS AND METHOD

CROSS-REFERENCE TO RELATED APPLICATIONS

This application claims priority to U.S. provisional patent application No. 62/269,653 filed Dec. 18, 2015, the entire contents of which are incorporated by reference herein.

TECHNICAL FIELD

The application relates generally to the fabrication of ornamental casted unit and, more particularly, to an apparatus and method for molding casted blocks.

BACKGROUND

Ornamental casted units can be manufactured with a hydraulic press. A known type of ornamental casted concrete unit includes a base layer of coarser material and a surface layer of finer, decorative material. A typical molding process for these two-layer units consists of a first feed box distributing a base mix of coarse concrete into a mold, which is then lightly pressed and/or vibrated so that the top of the compacted or compressed concrete is lower than the top of the mold. This compression and/or vibration also creates a smooth surface on top of the base mix. Soon after this compaction/compression, a face mix of finer concrete is added on top of the compacted base mix using a second, separate feed box travelling from the opposed side of the fabrication machine. The combined mixes are compressed and/or vibrated yet again. A linear junction is thus formed between the two mixes of concrete, which is susceptible to delamination.

Furthermore, the application of a second cycle of compression and/or vibration after the face mix of finer concrete is added increases the duration of the molding cycle, thereby reducing the number of production runs that can be performed in a given period.

SUMMARY

In one aspect, there is provided a casted block molding apparatus, comprising: a mold having a plurality of mold cavities for molding each casted block; a first filler box having a first bottom opening and a first cover for the first bottom opening, the first filler box being displaceable along opposed directions between an overlapping position where the first opening is located over the mold cavities and a retracted position where the first filler box is away from the mold cavities, the first bottom opening being closed by the first cover in the retracted position and being open when the first opening is over the mold cavities, a second filler box mounted to the first filler box and displaceable therewith along the opposed directions, the second filler box having a second bottom opening and a second cover for the second bottom opening, the second cover closing the second bottom opening when the first and second filler boxes are displaced from the retracted position to the overlapping position, the second bottom opening being open after the first filler box reaches the overlapping position; and a pressing mechanism having a press plate for each of the mold cavities, the pressing mechanism moveable between a first position where each press plate is spaced above the mold cavities, and a second position where each press plate is received in a respective one of the mold cavities.

In accordance with another aspect, there is provided a method for molding casted blocks, comprising: providing first and second interconnected filler boxes, the first filler box containing a base granular mixture and the second filler box containing a facing granular mixture; displacing the first and second filler boxes in a first direction toward and over mold cavities; as the first filler box passes over the mold cavities while displacing the first and second filler boxes in the first direction, distributing the base granular mixture from the first filler box to fill the mold cavities without distributing the facing granular mixture from the second filler box; displacing the first and second filler boxes over and away from the mold cavities in a second direction opposite to the first direction; as the second filler box passes over the mold cavities while or before displacing the first and second filler boxes in the second direction, distributing the facing granular mixture from the second filler box over the base granular mixture in the mold cavities; and while the first and second filler boxes are away from the mold cavities, pressing downwardly on the facing and base granular mixtures in the mold cavities to shape the casted blocks.

In a further aspect, there is provided a casted block molding apparatus, comprising: a mold supported by a frame and having a plurality of mold cavities for molding the casted blocks; a first filler box supported by the frame and having a first bottom opening, the first filler box being displaceable over the mold cavities in a first direction and an opposed second direction, the first filler box filling the mold cavities with a base granular mixture via the first bottom opening upon being displaced in the first direction; a second filler box mounted to a first end of the first filler box and displaceable therewith over the mold cavities, the second filler box having a second bottom opening and a cover engageable with the second bottom opening, the cover engaging the second bottom opening to retain a facing granular mixture within the second filler box while the first and second filler boxes are displaced over the mold cavities in the first direction, the cover disengaging from the second bottom opening to feed the facing granular mixture therethrough over the mold cavities on top of the base granular mixture while the first and second filler boxes are displaced over the mold cavities in the second direction; and a pressing mechanism movably supported by the frame and having a press plate for each of the mold cavities, each press plate moveable between a first position above the mold cavities, and a second position wherein each press plate presses downwardly on the facing and base granular mixtures in a respective one of the mold cavities to form the casted blocks.

DESCRIPTION OF THE DRAWINGS

Reference is now made to the accompanying figures in which.

DETAILED DESCRIPTION

Figure 1:
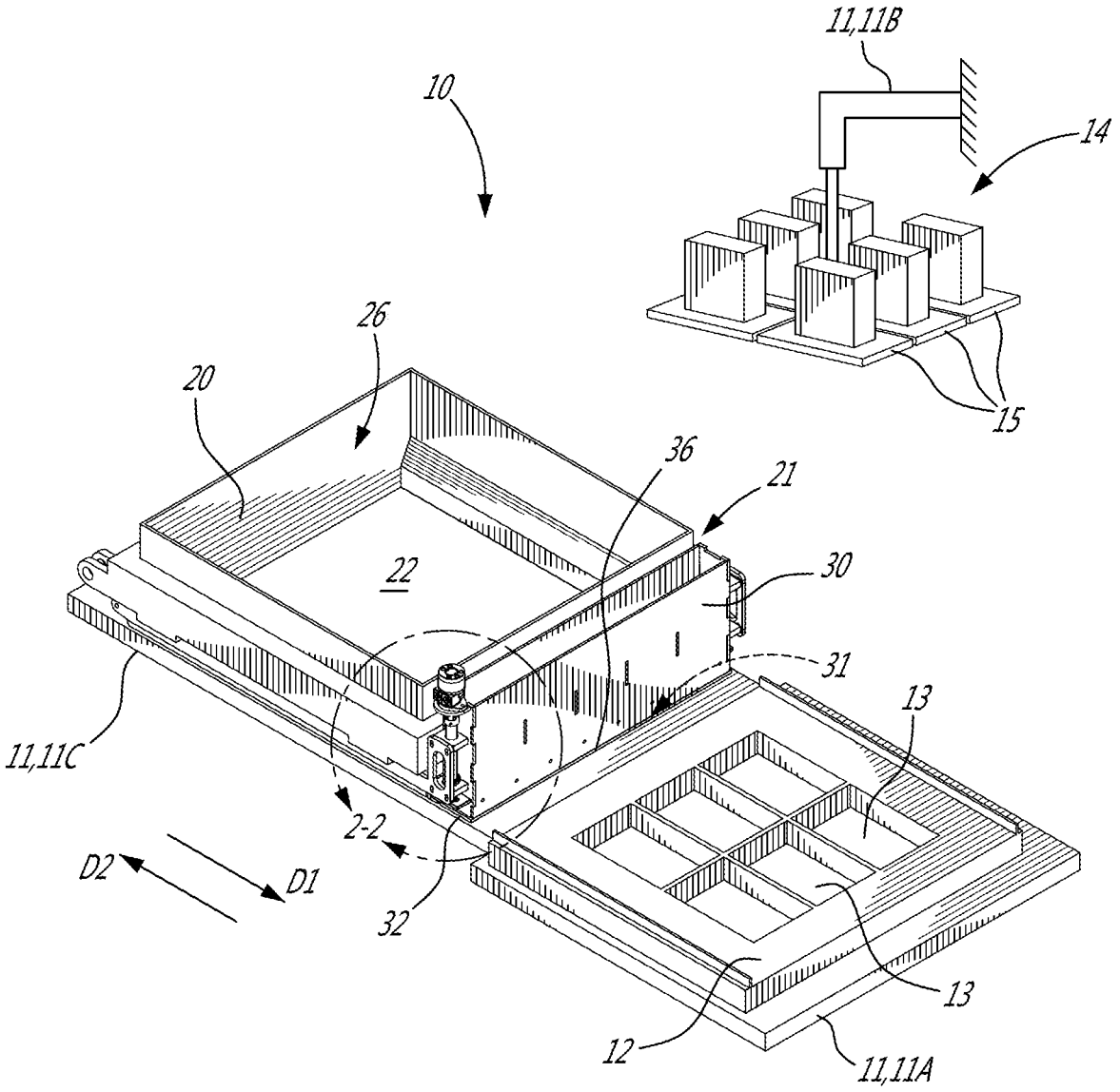
FIG. 1 is a schematic tridimensional view of a casted block molding apparatus having a first filler box and a second filler box, according to an embodiment of the present disclosure.

FIG. 1 illustrates a casted block molding apparatus 10. The casted block molding apparatus 10 (or simply "apparatus 10") is used to manufacture ornamental casted block products such as pavers and the like, which can be used for outdoor paving surfaces and walls, for example. The apparatus 10 operates as a hydraulic press in order to "dry cast" the casted blocks.

Dry casting refers to using compression and vibration to batch-prepare casted blocks from granular mixtures of stone material. The granular mixtures consist of granular stone material mixed with a minimum amount of water. One possible granular mixture which can be used with the apparatus 10 includes mixtures of sand and concrete, and thus reference to concrete mixtures is made herein. It will be appreciated that other granular mixtures are within the scope of the present disclosure and can be used with the apparatus 10. Dry casting is observed to give suitable handling characteristics, and can produce a high-strength concrete block. In a typical dry cast production run, the sand and concrete mixture is delivered into a steel mold supported on a steel plate and levelled out, by means of a box and agitator mechanism. Any surplus concrete is then removed by the withdrawal of the box. A hydraulically-operated vibrating press descends and compresses the concrete. Compaction is typically effective enough such that the molds can be removed and re-used immediately, leaving the molded concrete blocks intact on the support plate. The blocks, already quite firm and solid to the touch, can then be carried to a curing rack.

The apparatus 10 disclosed herein relates more particularly to the manufacture of non-homogenous concrete blocks. In these products, two or more concrete mixtures are used. When only two mixtures are used, the first mixture can be referred to as a "base mix", and can for example consist of low-cost and coarser concrete which makes up the bulk of the concrete block. The second mixture can be referred to as "facing mix" or "face mix", and forms the visible face of the concrete block. The face mix can form an exposed wall face between 8-10 mm thick in some embodiments, and typically consists of a higher grade concrete mixture that is more aesthetically pleasing, or which imparts certain properties to the concrete block. These non-homogenous concrete blocks minimise the use of relatively expensive components, such as the dyes or specifically-selected fine aggregates of the face mix, while still providing a concrete block that is visually appealing when installed.

Still referring to FIG. 1, the apparatus 10 has a frame 11 which provides structure thereto. The frame 11 can be a single structure or linkage connecting the components of the apparatus 10 together, or include multiple support structures each independently supporting one or more components of the apparatus 10. Accordingly, it is understood that although the various supports are described herein as portions of the frame, some or all of the portions may be independent from one another and/or unconnected to one another.

The frame 11 has a mold portion 11*a* supporting a mold 12. In the embodiment shown, the mold portion 11A of the frame 11 includes a bottom steel plate, and a plurality of mold cavities 13 are delimited by walls of the mold 12 cooperating with the plate 11A. The mold cavities 13 define the shape and profile of the concrete blocks to be manufactured. The mold cavities 13 can therefore be of any desired shape or dimension, and can each have similar or dissimilar shapes. The mold cavities 13 receive the base and facing mixtures therein. The apparatus 10 also has a pressing mechanism 14 or tamper which applies a compressive force to the concrete mixtures in the mold cavities 13. The pressing mechanism 14 has press plates 15 which have a resting position (shown) above the mold 12 and the mold cavities 13. Each of the press plates 15 can be received in a corresponding one of the mold cavities 13 and is complementary in shape with respect thereto. The pressing mechanism 14 is supported by the frame 11 and moveable with respect thereto. In the embodiment shown, the pressing mechanism 14 is actuated by a displacement mechanism attached to a portion 11B of the frame 11. The pressing mechanism 14 is moved so that each press plate 15 moves downwardly to compress the base and facing mixtures in a corresponding mold cavity 13, thereby forming the concrete blocks.

The apparatus 10 also has a first filler box 20 and a second filler box 30 which are configured to store the base mixture and the facing mixture, respectively, and to release the mixtures into the mold cavities 13. Each filler box 20,30 can therefore be any suitable container that has an opening in a bottom portion thereof which allows the corresponding concrete mixture to exit the filler box 20,30 by gravity. The second filler box 30 is connected to the first filler box 20. In the embodiment shown, the second filler box 30 is mounted to a forward end 21 of the first filler box 20. The forward end 21 is the extremity of the first filler box 20 that faces toward an initial or first direction D1 of displacement of the first filler box 20 when the apparatus 10 is operated. In another embodiment, the second filler box 30 is mounted to a rear, second end of the first filler box 20.

During operation of the apparatus 10, the filler boxes 20,30 are displaced together over the mold 12 and mold cavities 13 in the first direction D1, and in a second direction D2 that is opposite to the first forward direction D1. The descriptors "first", "second", "forward", and "rearward" used herein do not limit the direction of displacement of the filler boxes 20,30 to a particular orientation. Theses descriptors explain only that the filler boxes 20,30 advance together over the mold cavities 13, and then return together back over the mold cavities 13 to their original point of departure.

Still referring to FIG. 1, the base and facing mixtures can be retained within their respective first and second filler boxes 20,30 using any suitable mechanism. For example, in the embodiment shown, the first filler box 20 has a first bottom opening 22 in a bottom portion thereof. A stationary, flat base plate 11C, which forms part of the frame 11, extends from the mold support plate 11A. When the first filler box 20 is not located over the mold cavities 13, the base plate 11C is disposed underneath the first bottom opening 22 to retain the base mixture within the first filler box 20. The base plate 11C is parallel to, and coplanar with, an upper surface of the mold 12. In the embodiment shown, the base plate 11C serves as a first cover for the first bottom opening 22. As the first filler box 20 is displaced in the first direction D1, it slides over the base plate 110, which forces the base mixture within the first filler box 20 to move along the base plate 110 as it is pushed toward the first filler box 20. As the first filler box 20 advances past the end of the base plate 11C and over the mold 12, the first bottom opening 22 becomes unobstructed, and the base mixture falls through the first bottom opening 22 and into the mold cavities 13.

The second filler box 30 has a second bottom opening 31 to distribute the facing mixture. The second filler box 30 defines a straight edge 36 at the bottom of its front wall, for example for screeding the facing mixture deposited by the second filler box 30. A second cover 32 engages the second bottom opening 31 to retain the facing mixture within the second filler box 30. The second cover 32 also disengages from, or opens, the second bottom opening 31 spaced above the mold cavities 13 to release the facing mixture over the base mixture deposited in the mold cavities 13 to overfill the mold cavities 13. The release of the facing mixture can be achieved in various ways.

Figure 2:
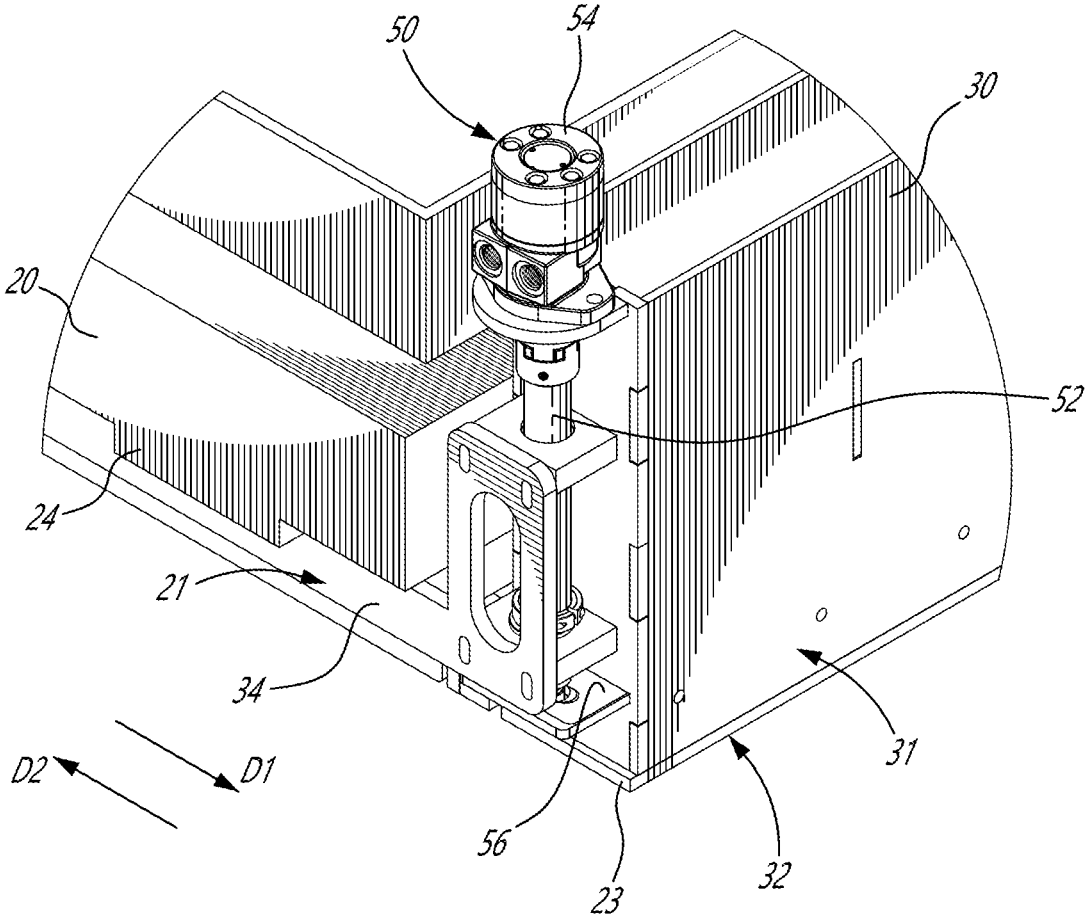
FIG. 2 is an enlarged tridimensional view of the area of the apparatus highlighted in FIG. 1.

Referring to FIG. 2, in the embodiment shown, the second cover 32 of the second filler box 30 includes a retention plate 23 extending forwardly from the forward end 21 of the first filler box 20. The retention plate 23 is fixedly attached to the first filler box 20 such that displacement of the first filler box 20 results in a corresponding displacement of the retention plate 23. The retention plate 23 engages with, and disengages from, the second bottom opening 31 of the second filler box 30. More particularly, the retention plate 23 obstructs the second bottom opening 31 and retains the facing mixture within the second filler box 30 while the first and second filler boxes 20,30 are displaced in the first direction D1.

In a particular embodiment, the bottom of the retention plate 23 is aligned with the bottom surface of the first filler box 20; the bottom surface of the second filler box 30 is thus located further away from the surface of the mold 22 than the bottom surface of the first filler box 20 by a distance corresponding to the thickness of the retention plate 23. The thickness of the retention plate 23 thus determines the thickness of the facing mixture deposited over the mold surface, and is selected in accordance with the desired thickness of facing mixture.

The retention plate 23 is displaced relative to the second filler box 30 when both the first and second filler boxes 20,30 are beginning their displacement in the second direction D2. More particularly, as the first filler box 20 begins its travel in the second direction D2, the second filler box 30 remains stationary; the retention plate 23 thus advances away from the second filler box 30 as the retention plate 23 is displaced with the first filler box 20 in the second direction D2. This "lag" or relative displacement between the boxes 20,30 is temporary, and allows the retention plate 23 to disengage from the second bottom opening 31 so that the facing mixture can exit the second filler box 30 and overfill the mold cavities. The retention plate 23 closes the second bottom opening 31 before the second filler box 30 leaves its position over the mold after having overfilled the mold cavities.

It is understood that the bottom openings 22,31 of the filler boxes 20,30 can alternately be selectively opened and closed using any other appropriate type of cover, including, but not limited to, covers movable through an active mechanism (e.g. motorized and actuated upon receipt of a signal) or through a passive mechanism (e.g. actuated through engagement with a portion of the apparatus 10 upon movement of the filler boxes 10,20).

The apparatus 10 may also include an agitation mechanism 50 that imparts vibration to the facing mixture being retained in the second filler box 30, which vibration may also be transmitted to the base mixture retained in the first filler box 20. In the embodiment shown, the agitation mechanism 50 is mounted to the second filler box 30, and includes an agitator shaft 52 driven by an agitator motor 54. An agitator blade 56 is mounted to the shaft 52 and driven thereby. The blade 56 imparts a vibratory motion to the contents of the second filler box 30, by agitating the second filler box 30 directly and/or by directly agitating the facing mixture within the second filler box 30.

Figure 3:
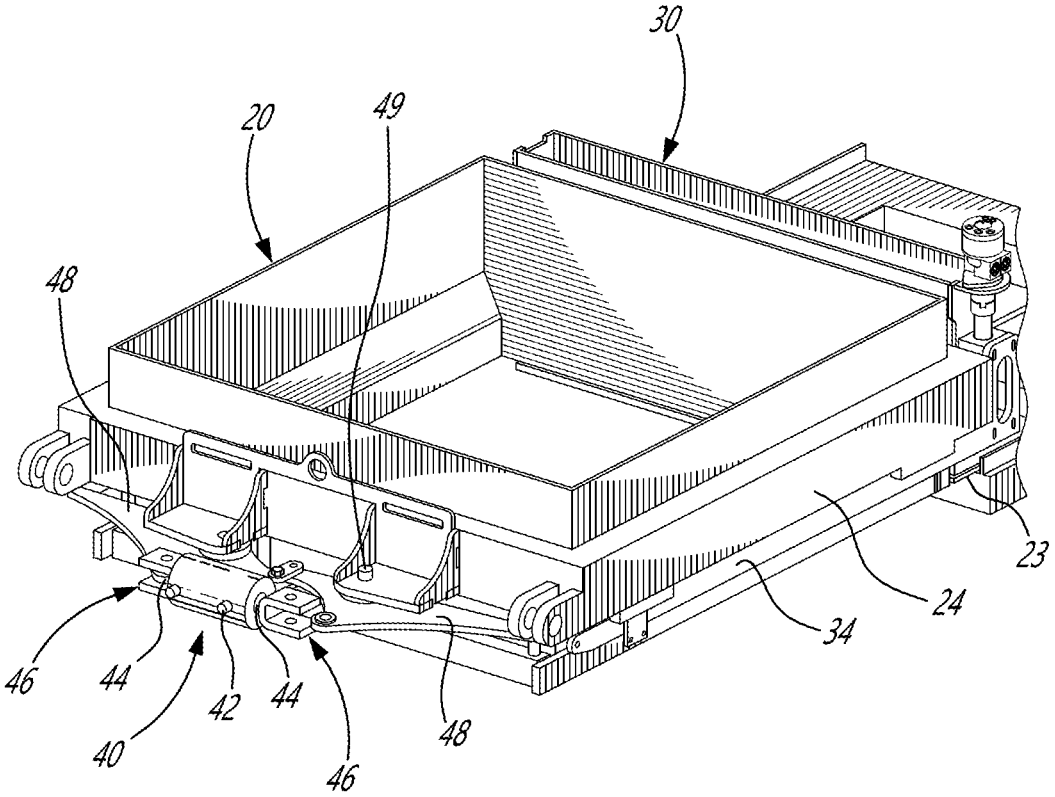
FIG. 3 is a schematic tridimensional view of the apparatus of FIG. 1, shown with an actuating mechanism according to a particular embodiment of the present disclosure.

Various mechanisms for achieving the above-described "lag" movement and the relative displacement of the filler boxes 20,30 are within the scope of the present disclosure. One example of such mechanism is shown in FIG. 3. In the embodiment shown, a first pair of elongated support arms 24 are rigidly mounted to the first filler box 20. The first support arms 24 each engage a respective one of a second pair of elongated support arm 34 mounted to the second filler box 30. The first and second support arms 24,34 are slidably displaceable relative to one another along a limited sliding path, which allows the first and second filler box 20,30 to be displaced relative to one another. The relative movement does not need to exceed the movement necessary to open the second bottom opening.

An actuating mechanism 40 engages the support arms 34 on either side of the second filler box 30 to displace them, and thus the second filler box 30, toward and away from the first filler box 20. The actuating mechanism 40 is mounted to a rear second end of the first filler box 20 and displaceable therewith. It has an actuator 42 of any suitable type (e.g. hydraulic, pneumatic, electric, etc.) with two rods 44 which are extendable in opposite directions away from the actuator 42. A distal extremity 46 of each rod 44 pivotally engages a pivot plate 48, and each pivot plate 48 is pivotally mounted to the second end of the first filler box 20 through a pivot connection 49 with a bracket extending from the first filler box 20, and is also pivotally mounted to an end of a corresponding support arm 34 of the second filler box 30. The extension of each rod 44 away from the actuator 42 causes the pivot plate 48 to pivot and to drive the second support arm 34 forward, i.e. away from the first filler box 20, such that the second filler box 30 is pushed away from the first filler box 20. When this is done the second filler box 30 is caused to "lag" behind the first filler box 20, as described above. The retraction of each rod 44 toward the actuator 42 causes the pivot plate 48 to pivot and to draw the second support arm 34 backward, i.e. toward the first filler box 20, such that the second filler box 30 is drawn towards the first filler box 20.

Figure 4A:
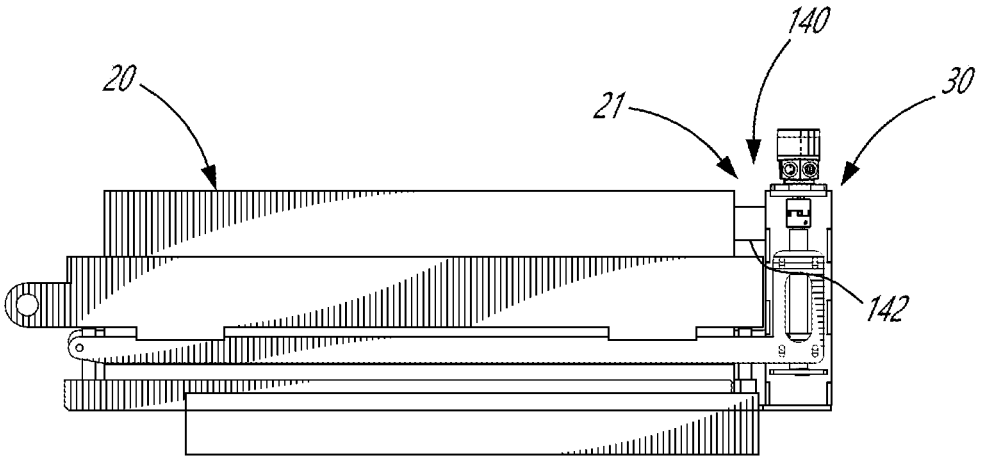
FIG. 4A is a schematic tridimensional view of the apparatus of FIG. 1, shown with an actuating mechanism according to another embodiment of the disclosure.
Figure 4B:
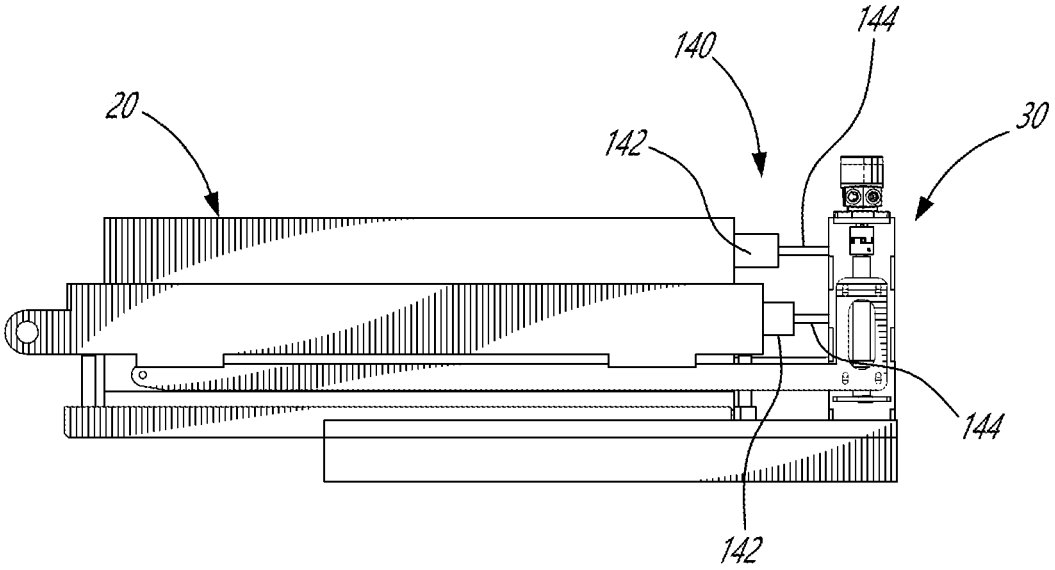
FIG. 4B is a schematic tridimensional view of the apparatus and actuating mechanism of FIG. 4A, showing the actuating mechanism in an extended position.

Another embodiment of the mechanism achieving the "lag" movement is shown in FIGS. 4A and 4B. The actuating mechanism 140 includes at least one actuator 142 mounted to a forward end 21 of the first filler box 20 and displaceable therewith. The extendable rod 144 of each actuator 142 is connected to the second filler box 30, and extends to displace the second filler box 30 relative to the first filler box 20. The extension of each rod 144 is synchronized. The extension of each rod 144 against the second filler box 20 pushes the second filler box 30 away from the first filler box 20, thereby creating the "lag" described above when both filler boxes 20,30 are being displaced (FIG. 4B). The retraction of each rod 144 draws the second filler box 30 backward toward the first filler box 20 (FIG. 4A).

The operation of the apparatus 10 in accordance with a particular embodiment will now be explained in greater detail below with reference to FIGS. 5A to 7B.

Figure 5A:
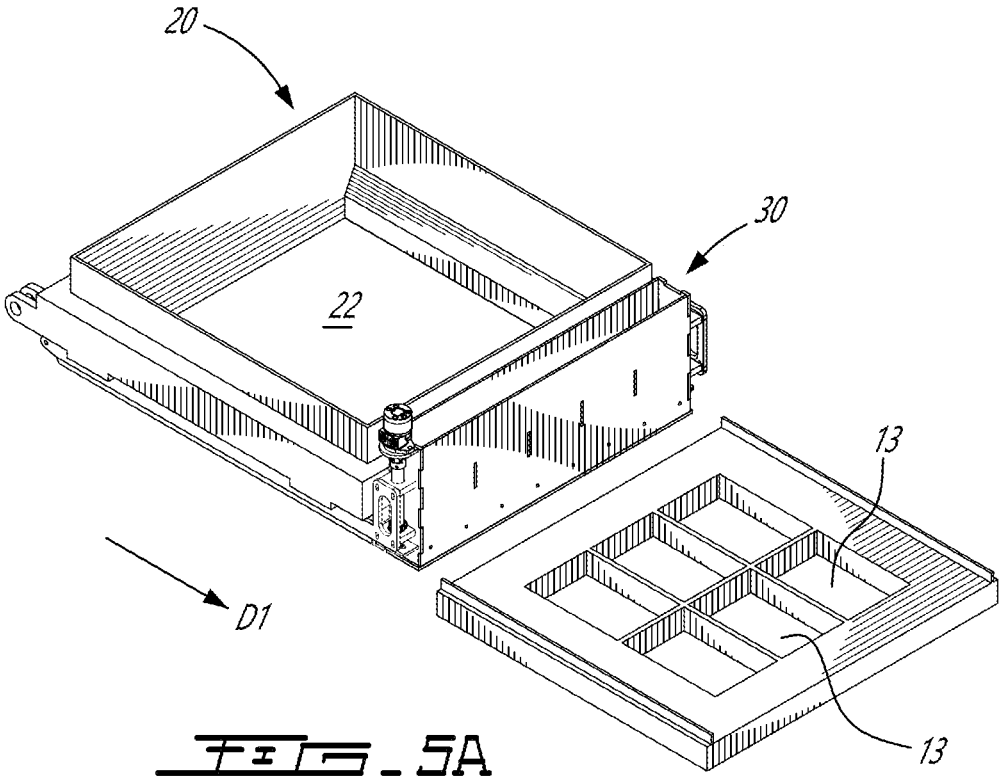
FIG. 5A is a schematic tridimensional view of the apparatus of FIG. 1, showing the first and second filler boxes travelling in a first direction.
Figure 5B:
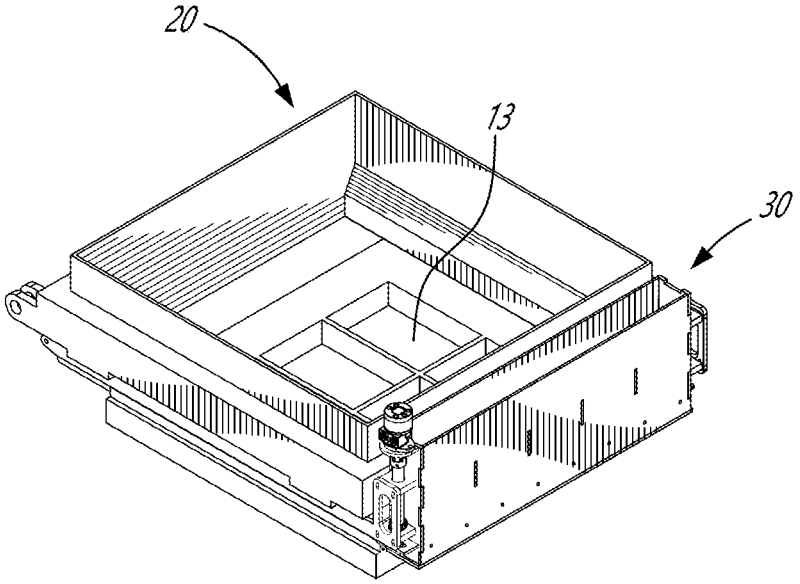
FIG. 5B is another schematic tridimensional view of the apparatus of FIG. 1, shown after the first and second filler boxes have travelled in the first direction.

The first and second filler boxes 20,30 move in the first direction D1 from an initial retracted position (FIG. 5A) to an overlapping position where the first filler box 20 is located over the mold cavities 13 (FIG. 5B). The first and second filler boxes 20,30 are displaced together when advancing in the first direction D1. As the first filler box 20 is displaced over the mold cavities 13 in the first direction D1, the base mixture is released from the first filler box 20 via the first bottom opening 22 to add the base mixture to the mold cavities 13. The first filler box 20 fills the mold cavities 13 completely with the base mixture. The second filler box 30 passes over the mold cavities 13 before the first filler box 20, but remains closed as the filler boxes 20,30 move in the first direction D1. In the overlapping position, the second filler box 30 has moved beyond the mold cavities 13.

Figure 6A:
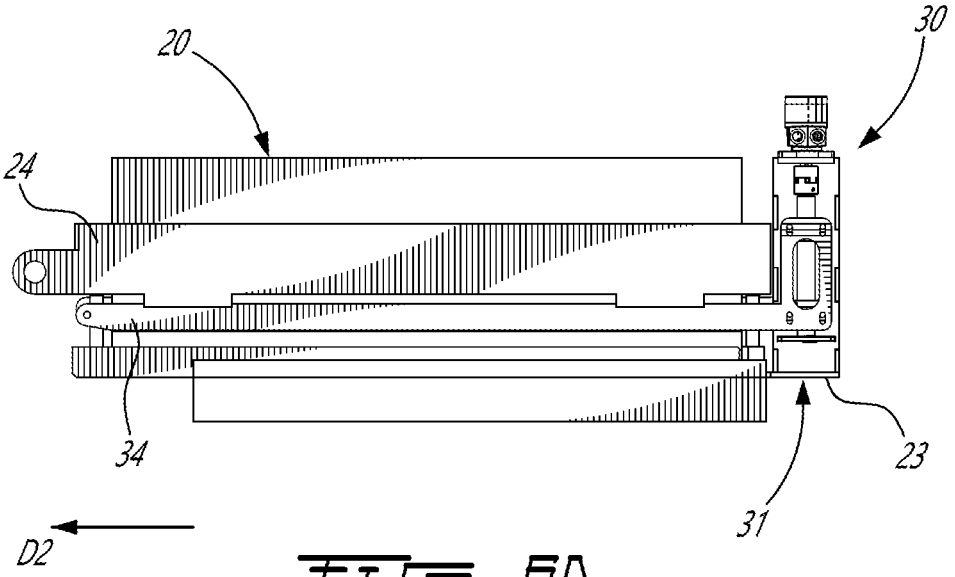
FIG. 6A is yet another schematic tridimensional view of the apparatus of FIG. 1, shown before the first and second filler boxes begin travelling in a second direction.
Figure 6B:
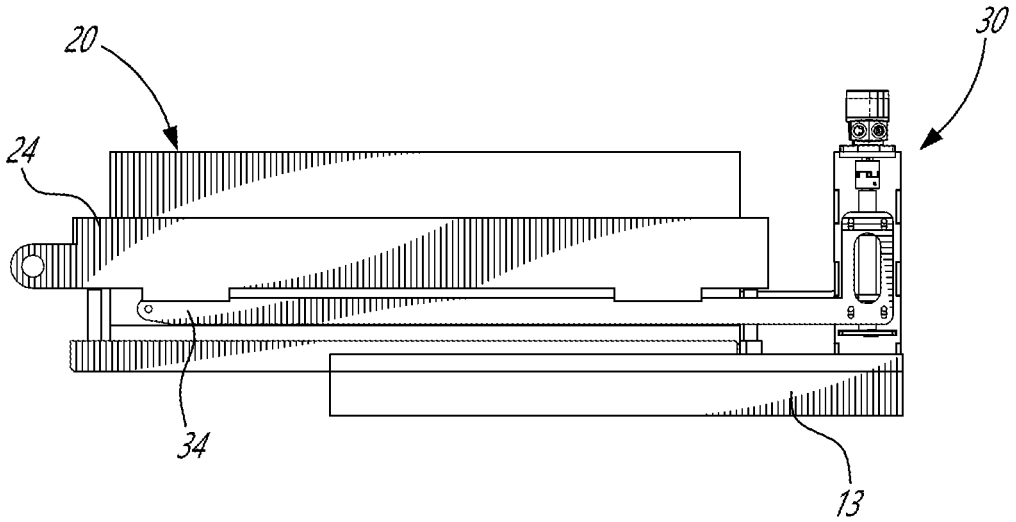
FIG. 6B is yet another schematic tridimensional view of the apparatus of FIG. 1, showing the first and second filler boxes moving relative to one another.

FIGS. 6A to 6B show the displacement of the first and second filler boxes 20,30 in the second direction D2 back toward the retracted position. As can be seen in FIG. 6A, after the first filler box 20 has performed its function of filling the mold cavities 13, both filler boxes 20,30 begin to return back over the mold cavities 13 in the second direction D2. Initially, the first filler box 20 travels in the second direction D2 while the second filler box 30 remains stationary, as shown in FIG. 6B, such that the second filler box 30 "lags" behind the first filler box 20. The actuating mechanisms described above may be used to cause this lag movement. This lag or relative movement between the boxes 20,30 allows the retention plate 23 to advance away from the second filler box 30 in the second direction D2 so that it disengages from the second bottom opening 31 and allows the facing mixture to exit the second filler box 30 and fill the mold cavities 13.

Figure 7A:
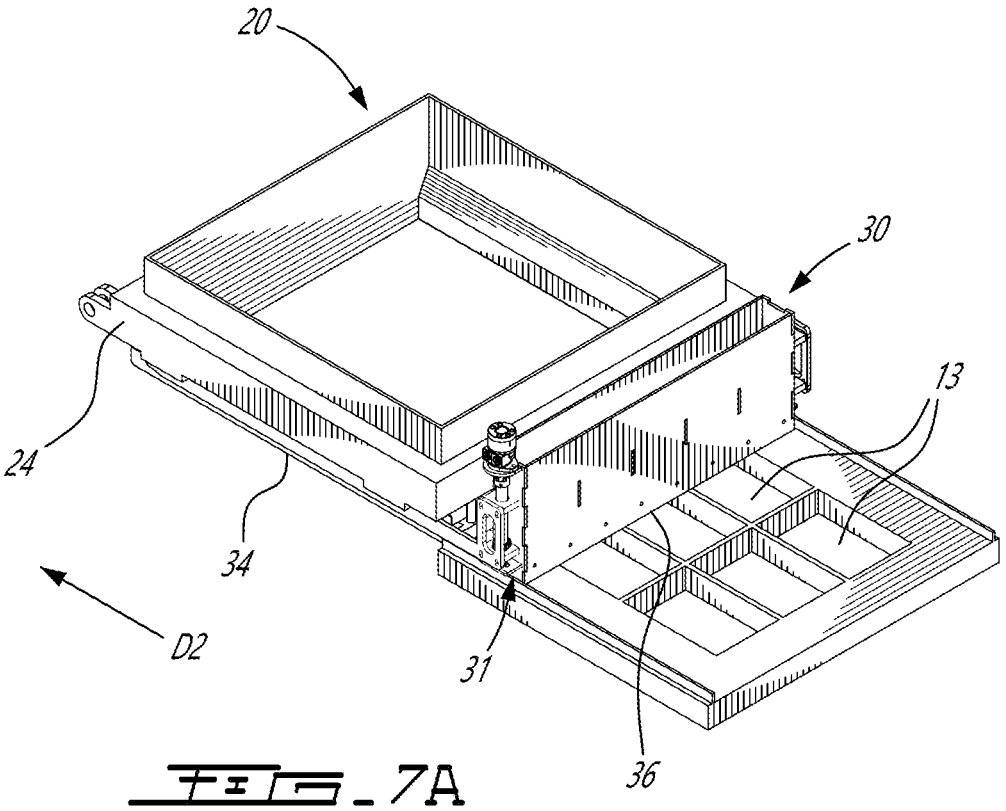
FIG. 7A is yet another schematic tridimensional view of the apparatus of FIG. 1, showing the first and second filler boxes travelling in the second direction with the second filler box following the first filler box.

During the initial displacement of the first filler box 20 in the second direction D2, the first support arms 24, which are fixed with respect to the first filler box 20, are slidably displaced relative to the second support arms 34, which are fixed with respect to the second filler box 30. This displacement of the first support arms 24 relative to the second support arms 34 (and accordingly of the first filler box 20 relative to the second filler box 30) occurs only as much as is required to disengage the retention plate 23 from the second bottom opening 31. From this point onward, and as shown in FIG. 7A, relative movement between the first and second support arms 24,34 is prevented, and the filler boxes 20,30 are displaced together in the second direction D2.

Figure 7B:
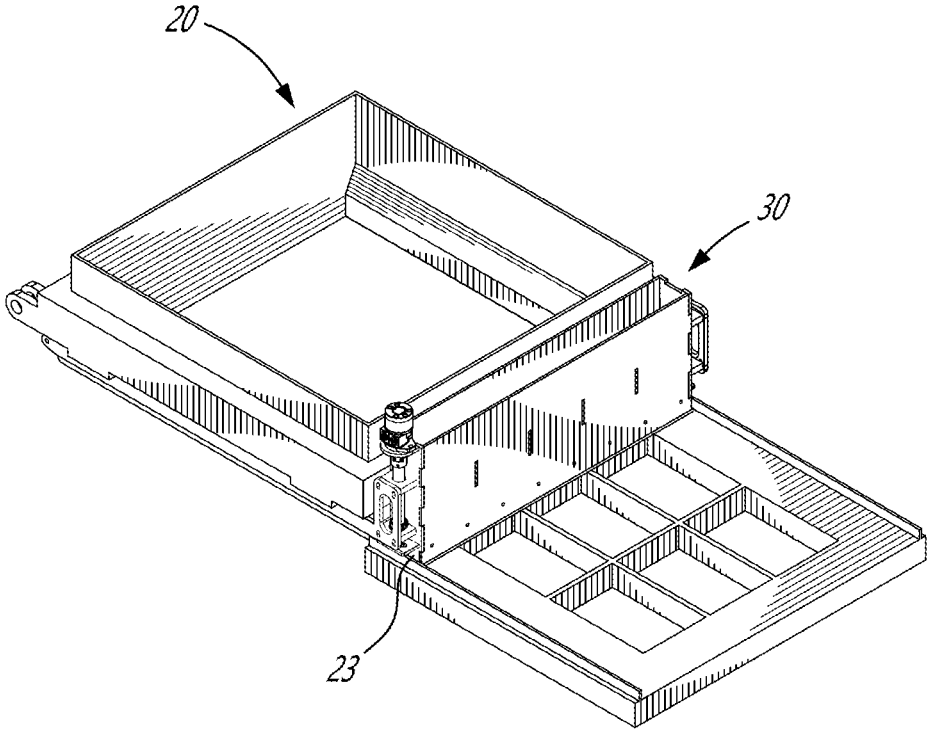
FIG. 7B is yet another schematic tridimensional view of the apparatus of FIG. 1, shown after the first and second filler boxes have travelled in the second direction.

The second filler box 30 deposits the facing mixture over the base mixture in the mold cavities 13 while it is being displaced in the second direction D2. The facing mixture is deposited so as to overfill and cover an exposed upper portion of the base mixture in each mold cavity 13. The mold cavities 13 are therefore overfilled. The first and second filler boxes 20,30 are then returned toward the retracted position, as shown in FIG. 7B, where the first and second support arms 24,34 slide with respect to each other in the opposite direction such as to bring the second filler box 30 back over the retention plate 23 to close the second bottom opening 31. The actuating mechanisms described above may be used to draw the second filler box 30 toward the first filler box 20.

The passage of the second filler box 30 over the mold cavities in the second direction D2 may level out or more evenly distribute the facing mixture over the mold cavities 13 by screeding to achieve an even surface deposit. More particularly, the second filler box 30 can be spaced above the mold cavities a distance which corresponds to the thickness of the retention plate 23. As the retention plate 23 is withdrawn to disengage from the second bottom opening 31, the facing mixture is deposited into the mold cavities 13. The straight edge 36 or strip of the second filler box 30 acts like a screed by engaging the recently deposited facing mixture and levelling it out over the mold cavities as the second filler box 30 is displaced in the second direction D2.

Alternately, in an embodiment where the second filler box 30 is retained on the rear end of the first filler box 20 as mentioned above, the boxes 20, 30 continue moving in the first direction D1 after the first filler box has reached the overlapping position, and the second bottom opening 31 is opened as the second filler box 30 passes over the mold cavities 13 to deposit the facing mixture over the base mixture, whether during the travel in the first direction D1, or during the travel back the retracted position in the second direction D2.

Once both mixtures are deposited, the base and face concrete mixtures in each mold cavity 13 are compressed together with the press plates 15 of the pressing mechanism 14 within the mold cavities 13. In some embodiments, the press plates 15 impart a vibration to the base and face mixtures while the press plates 15 press downwardly thereon.

Figure 8:
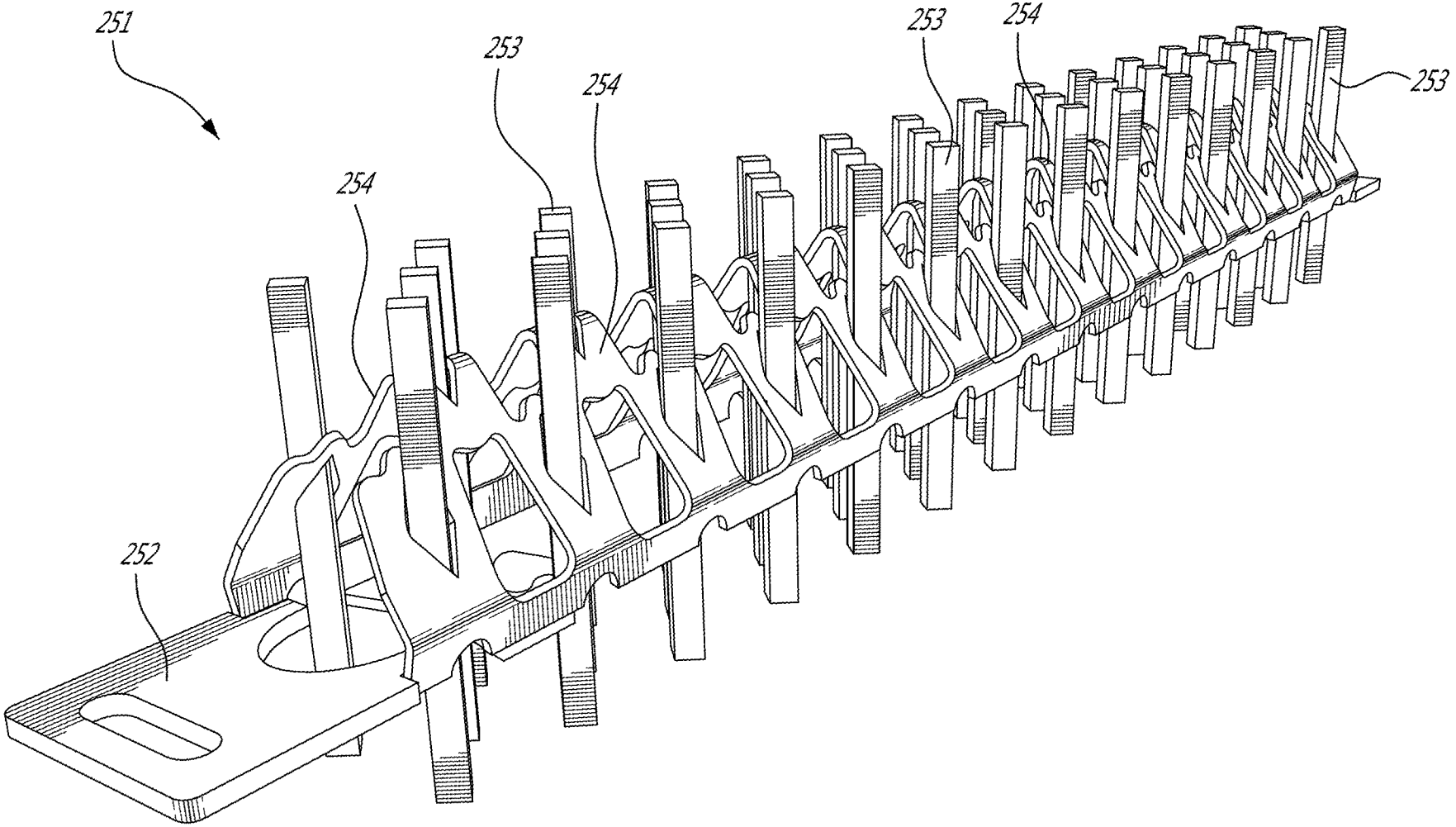
FIG. 8 is a schematic tridimensional view of an agitator for the second filler box.

FIG. 8 shows a displaceable agitator 251 to impart vibration to the facing mixture being retained in the second filler box 30. It is observed that the facing mixture may settle and become compact when the first and second filler boxes 20,30 are displaced. The agitator 251 helps the facing mixture to maintain its granularity during displacement, which facilitates the distribution of the facing mixture within the mold cavities 13. The agitator 251 includes a displacement plate 252 which, when mounted to the second filler box 30, is disposed within an inner volume of the second filler box 30. The displacement plate 252 is mechanically coupled to a suitable drive (e.g. actuator, motor, etc.) to displace within the second filler box 30, such as in a reciprocating fashion. For example, the displacement plate 252 can be coupled to the agitator motor 54 of the agitation mechanism 50 described above. The agitator 251 also includes a plurality of mixing rods 253 mounted to the displacement plate 252 for mixing the facing mixture within the second filler box 30. A plurality of ridges 254 are mounted to the displacement plate 252 about the mixing rods 253. The ridges 254 allow the facing mixture to collect thereon, and thus serve to suspend some of the facing mixture above a remainder of the facing mixture.

In light of the preceding, it can be appreciated that the sequential deposition of the base and facing mixtures in the mold cavities without "tamping" or compressing each mixture between their deposition reduces cycle durations and increases the number of cycles which can be run in a given time period. This reduced cycle time compares favourably to certain conventional dry cast machines having separate filler boxes moving from opposite directions, which compress the base mixture in the mold cavities before adding the facing mixture.

Moreover, in a particular embodiment, the present apparatus 10 allows for two-layer blocks to be formed using the same cycle time as single layer blocks: no additional time is required to add a second layer (i.e. the face mixture) to the base mixture, as the addition of the face mixture is performed during the movement of the first filler box back to its initial position, which is already present in the molding cycle for single layer blocks. The cycle and movement of the first filler box is therefore not changed between molding single layer and two layer blocks.

It can also be appreciated that the relatively rapid deposition of the facing mixture over the base mixture before any compression occurs helps to form non-linear junctions between the facing and base mixtures within each mold cavity. These complex junctions may be less prone to delamination because there is more intermingling between the components that make up the layers, particularly when compared to the substantially linear junction formed in conventional machines when the base mixture is tampered before the addition of the facing mixture.

Furthermore, the screeding performed by the second filler box as it travels in the second direction provides a consistency to the thickness of the layer of facing mixture, which is evenly deposited over the mold surface. The thickness of the facing mixture is therefore not affected by the "raking" and/or "digging" associated with conventional techniques where the facing mixture is deposited in the mold cavities. This consistency contributes to providing a consistent layer of the facing mixture in the finished block.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A casted block molding apparatus, comprising:

a mold having a plurality of mold cavities for molding each casted block;

a first filler box having a first bottom opening and a first cover for the first bottom opening, the first filler box being displaceable along opposed directions between an overlapping position where the first opening is located over the plurality of mold cavities and a retracted position where the first filler box is away from the mold cavities, the first bottom opening being closed by the first cover in the retracted position and being open when the first opening is over the plurality of mold cavities, a second filler box mounted to the first filler box and displaceable therewith along the opposed directions, the second filler box having a second bottom opening and a second cover for the second bottom opening, the second cover closing the second bottom opening when the first and second filler boxes are displaced from the retracted position to the overlapping position, the second bottom opening being open after the first filler box reaches the overlapping position; and a pressing mechanism having a press plate for each of the mold cavities, the pressing mechanism moveable between a first position where each press plate is spaced above the mold cavities, and a second position where each press plate is received in a respective one of the mold cavities.

2. The apparatus as defined in claim 1, wherein the first filler box has a first end and an opposed second end, the first end being located closer to the mold than the second end when the first filler box is in the retracted position, the second filler box mounted to the first end of the first filler box, the second bottom opening being open when the first and second filler boxes are displaced from the overlapping position to the retracted position.

3. The apparatus as defined in claim 1, wherein the first cover includes a fixed plate extending from the mold, the fixed plate extending under the first filler box when the first filler box is in the retracted position.

4. The apparatus as defined in claim 1, wherein the second cover includes a retention plate extending from the first filler box under the second filler box, the retention plate having a fixed position with respect to the first filler box, the second filler box being movable relative to the first filler box between a closed position where the second opening is obstructed by the retention plate and an open position away from the first end of the first filler box where the second opening is unobstructed.

5. The apparatus as defined in claim 4, wherein a bottom surface of the second filler box is located further away from the mold surface than a bottom surface of the first filler box by a distance corresponding to a thickness of the retention plate.

6. The apparatus as defined in claim 1, further comprising a first pair of elongated support arms mounted to opposed sides of the first filler box and a second pair of elongated support arms mounted to opposed sides of the second filler box, each of the first support arms engaging a respective one of the second elongated support arms, the first and second support arms being slidably displaceable relative to one another along a limited sliding path such that the second filler box is movable relative to the first filler box between a closed position where the second opening is obstructed by the second cover and an open position away from the first end of the first filler box where the second opening is unobstructed.

7. The apparatus as defined in claim 1, further comprising an agitation mechanism mounted to the second filler box to agitate contents thereof.

8. The apparatus as defined in claim 1, wherein the pressing mechanism includes an agitator mechanism engaging the mold cavities to provide vibration thereto.

9. A casted block molding apparatus, comprising:

a mold supported by a frame and having a plurality of mold cavities for molding the casted blocks;

a first filler box supported by the frame and having a first bottom opening, the first filler box being displaceable over the plurality of mold cavities in a first direction and an opposed second direction, the first filler box filling the mold cavities with a base granular mixture via the first bottom opening upon being displaced in the first direction;

a second filler box mounted to a first end of the first filler box and displaceable therewith over the plurality of mold cavities, the second filler box having a second bottom opening and a cover engageable with the second bottom opening, the cover engaging the second bottom opening to retain a facing granular mixture within the second filler box while the first and second filler boxes are displaced over the mold cavities in the first direction, the cover disengaging from the second bottom opening to feed the facing granular mixture therethrough over the plurality of mold cavities on top of the base granular mixture while the first and second filler boxes are displaced over the mold cavities in the second direction; and a pressing mechanism movably supported by the frame and having a press plate for each of the mold cavities, each press plate moveable between a first position above the mold cavities, and a second position wherein each press plate presses downwardly on the facing and base granular mixtures in a respective one of the mold cavities to form the casted blocks.

10. The apparatus as defined in claim 9, wherein the first cover includes a fixed plate extending from the mold, the fixed plate extending under the first filler box to close the first opening when the first filler box is away from the mold cavities.

11. The apparatus as defined in claim 9, wherein the second cover includes a retention plate extending from the first filler box under the second filler box, the retention plate having a fixed position with respect to the first filler box, the second filler box being movable relative to the first filler box between a closed position where the second opening is obstructed by the retention plate and an open position away from the first end of the first filler box where the second opening is unobstructed.

12. The apparatus as defined in claim 11, wherein a bottom surface of the second filler box is located further away from the mold surface than a bottom surface of the first filler box by a distance corresponding to a thickness of the retention plate.

13. The apparatus as defined in claim 9, further comprising a first pair of elongated support arms mounted to opposed sides of the first filler box and a second pair of elongated support arms mounted to opposed sides of the second filler box, each of the first support arms engaging a respective one of the second elongated support arms, the first and second support arms being slidably displaceable relative to one another along a limited sliding path such that the second filler box is movable relative to the first filler box between a closed position where the second opening is obstructed by the second cover and an open position away from the first end of the first filler box where the second opening is unobstructed.

* * * * *